US006294617B1

(12) United States Patent
Rajagopalan

(10) Patent No.: US 6,294,617 B1
(45) **Date of Patent: *Sep. 25, 2001**

(54) GOLF BALL FORMING COMPOSITIONS COMPRISING POLYAMIDE

(75) Inventor: Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/311,288

(22) Filed: May 14, 1999

Related U.S. Application Data

(62) Division of application No. 08/862,831, filed on May 23, 1997, now Pat. No. 5,981,654.

(51) Int. Cl.[7] ..... A63B 37/00; A63B 37/02; A63B 37/12; C08L 77/00

(52) U.S. Cl. ..... 525/425; 525/66; 525/432; 473/354; 473/361; 473/374; 473/375

(58) Field of Search ..... 525/66, 425, 432; 473/354, 374, 375, 361

(56) References Cited

U.S. PATENT DOCUMENTS

| | | | |
|---|---|---|---|
| 3,870,841 | 3/1975 | Makowski et al. | 260/23.7 R |
| 4,102,876 | 7/1978 | Brenner et al. | 526/19 |
| 4,234,184 | 11/1980 | Deleens et al. | 273/235 |
| 4,255,540 | 3/1981 | Weiss | 525/332 |
| 4,679,795 | 7/1987 | Melvin et al. | 273/235 |
| 4,840,982 | 6/1989 | Campbell et al. | 524/151 |
| 4,858,924 | 8/1989 | Saito et al. | 273/235 |
| 4,956,438 | 9/1990 | Ruetman et al. | 528/60 |
| 4,968,038 | 11/1990 | Yamada | 273/232 |
| 4,986,545 | 1/1991 | Sullivan | 273/235 |
| 5,098,105 | 3/1992 | Sullivan | 273/235 |
| 5,155,157 | 10/1992 | Statz et al. | 525/183 |
| 5,253,871 | 10/1993 | Viollaz | 273/228 |
| 5,321,089 | 6/1994 | Cardorniga et al. | 525/196 |
| 5,334,673 | 8/1994 | Wu | 273/235 |
| 5,359,000 | 10/1994 | Hamada et al. | 525/74 |
| 5,484,870 | 1/1996 | Wu | 528/28 |
| 5,556,098 | 9/1996 | Higuchi et al. | 473/373 |
| 5,679,745 | 10/1997 | Hamada et al. | 525/195 |
| 5,688,191 | 11/1997 | Cavallaro | 473/378 |
| 5,692,974 | 12/1997 | Wu et al. | 473/377 |
| 5,733,974 | 3/1998 | Yamada | 473/377 |
| 5,820,486 | 10/1998 | Tanaka et al. | 473/374 |
| 5,886,103 | 3/1999 | Bellinger et al. | 525/179 |
| 6,001,930 * | 12/1999 | Rajagopalan . | |

FOREIGN PATENT DOCUMENTS

| | | |
|---|---|---|
| A-60631/96 | 1/1997 | (AU) . |
| 1 04 7254 | 11/1966 | (GB) . |
| 2 278 609 | 12/1994 | (GB) . |
| 2 292 387 | 2/1996 | (GB) . |
| 63 009461 | 1/1988 | (JP) . |
| 6-192512 | 7/1994 | (JP) . |
| 081873 06 A2 | 7/1996 | (JP) . |
| 9-658 | 1/1997 | (JP) . |
| 09070451 | 3/1997 | (JP) . |

OTHER PUBLICATIONS

Advances in Urethane Ionomers, Technomic Publishing Co., Inc., H.X. Xiao and K.C. Frisch.

W.J. MacKnight and T.R. Earnest, Jr., Journal of Polymer Science Macromolecular Reviews, 16:99–101 (1981).

Z. Gao et al., Macromol., 25:6460–6465 (1992).

X. Lu and R.A. Weiss, Macromol., 25:6185–6189 (1992).

R.A. Weiss and X. Lu, Polymer, 35(9):1963–1969 (1994).

P. Rajagopalan et al., J. Polym. Sci. Pt. B, Polym. Physics, 33:495–503 (1995).

* cited by examiner

*Primary Examiner*—David J. Buttner
(74) *Attorney, Agent, or Firm*—Pennie & Edmonds LLP

(57) ABSTRACT

The present invention relates to a golf ball comprising a core layer, at least one intermediate layer, and a cover layer, wherein the core layer or the at least one intermediate layer are formed from compositions comprising a polyamide, in the form of a homopolymer, a copolymer, or mixtures thereof. The compositions comprise about 1 to about 99 weight percent of at least one nonionomer polymer and about 99 to about 1 weight percent of at least one polyamide polymer. The polyamides of the present invention comprise polyamides and polyamide copolymers, such as nylons, nylon copolymers, and nylon block copolymers. The nonionomer polymer comprises a nonionomer thermoplastic elastomer or a nonionomer thermoplastic. The present invention also relates to a method of making a golf ball comprising forming a golf ball core, preparing a composition comprising about 1 to about 99 weight percent of at least one nonionomer polymer and about 99 to about 1 weight percent of at least one polyamide polymer, and molding the blend around the golf ball core to form the golf ball.

28 Claims, No Drawings

GOLF BALL FORMING COMPOSITIONS COMPRISING POLYAMIDE

This is a divisional, of application Ser. No. 08/862,831, filed May 23, 1997 now U.S. Pat. No. 5,981,654.

TECHNICAL FIELD

The present invention is directed to compositions and methods for forming golf ball covers, cores and intermediate layers and a golf ball formed of said compositions having improved properties, in particular, improved resiliency and greater distance. The compositions of the invention comprise at least one polyamide, in the form of a homopolymer, a copolymer or mixtures thereof.

BACKGROUND OF THE INVENTION

Three-piece, wound balls with balata (trans-polyisoprene) covers are typically preferred by professional and low handicap amateur golfers. These balls provide a combination of distance, high spin rate, and control that is not available with an ionomer cover or in one-piece and two-piece balls. However, balata cuts easily, and lacks the durability required by the average golfer.

Two-piece golf balls, which are typically used by the average amateur golfer, provide a combination of durability and maximum distance that is not available with balata covered balls. These balls comprise a core, formed of a solid sphere which typically comprises a polybutadiene based compound, encased in an ionomer cover formed of, e.g., SURLYN®. These ionomers are ionic copolymers of an olefin and an unsaturated carboxylic acid in which at least a portion of the carboxylic acid groups have been neutralized with a metal ion. These balls are extremely durable, have good shear resistance and are almost impossible to cut. However, the durability results from the hardness of the ionomer, which gives such balls a very hard "feel" when struck with a golf club that many golfers find unacceptable.

Golf ball manufacturers have attempted to produce golf ball covers that provide the spin rate of balata with the cut resistance of an ionomer by forming blends of high hardness and low hardness ionomers, e.g., U.S. Pat. Nos. 4,884,814, 5,120,791, 5,324,783 and 5,492,972. However, none of the disclosed ionomer blends have resulted in the ideal balance of carrying distance, coefficient of restitution, spin rate and initial velocity that would approach the highly-desirable playability of a balata covered golf ball. This approach is exemplified in U.S. Pat. No. 5,415,937 to Cadorniga et al. Cadorniga et al. disclose a golf ball cover material consisting of a blend of a high stiffness ionomer, preferably with a Shore D hardness of at least 70 and a flexural modulus of 60,000 to 120,000 psi, and a very low modulus ionomer, preferably with a Shore D hardness of 20 to 50 and a flexural modulus of 2,000 to 8,000 psi. The purpose is to improve the feel and playability of the ball when compared to a standard ionomer cover, while retaining the distance and resilience of the prior art balls. Golf balls having covers incorporating the disclosed blends have a slightly improved coefficient of restitution and initial velocity with spin rates that range from slightly better than prior art blends to significantly lower, depending upon the particular blend and the club used in the test, i.e., driver, 5-iron, or pitching wedge.

Manufacturers have also attempted to form blends of hard ionomers with softer, nonionomer polymers to soften the golf ball and improve its feel and spin rate. However, this approach has proven to be difficult because the ionic character of ionomers imparts a highly polar nature to these materials. Therefore, ionomers and other nonionomer polymers, such as balata, and polyolefin homopolymers, copolymers, or terpolymers that do not contain ionic, acidic, basic, or other polar pendant groups, have not been successfully blended for use in golf ball covers. These mixtures often have poor mechanical properties such as inferior tensile strength, impact strength, and the like. Hence, the golf balls produced from these immiscible mixtures will have inferior golf ball properties such as poor durability and cut resistance on impact.

Adding polar functionality to nonpolar polymers is another approach which has been used to facilitate the blending of nonionomers with ionomers for golf ball cover materials. For example, U.S. Pat. Nos. 4,986,545, 5,098,105 and 5,359,000 all disclose compatible or miscible blends between ionomers and another polymer. Compatibility is accomplished by imparting polar functionality to the nonionomer through a reaction with maleic anhydride. None of these patents, however, discloses blends of nonionomer polymers with polyamides.

Because of the difficulties encountered when attempting to blend ionomers with other polymers, manufacturers have used compatibilizers to provide or enhance the compatible nature of such blends; see, for example, U.S. Pat. No, 5,321,089. The compatibilizer material is often a block copolymer where each block has an affinity for only one of the blend components to be compatibilized. The compatibilizer is thought to associate across the boundaries between phase-separated regions in the polymer blend. It is used to bind the regions together and to enhance the structural integrity and mechanical properties of the resulting compatibilized material.

U.S. Pat. No, 5,155,157 to Statz et al. describes thermoplastic elastomer (hereafter "TPE") compositions that are blends of a copoly(ether-amide) with an acid-containing ethylene copolymer ionomer and an epoxy containing compound, for use in one-piece golf balls and as cores for two-piece and three-piece golf balls. Japanese patent application 6192512 A (1994) discloses compositions which are blends of a thermoplastic polyamide elastomer, an ethylene copolymer ionomer and an epoxy-containing compound for use in two-piece and three-piece golf ball covers and cores. In each of these disclosures or publications, a costly custom-synthesized compatibilizer component is required to compatibilize a blend of one or more ionomers with a polymer that is immiscible with the ionomer. None of the above disclosures or publications teaches a blend of a nonionomer polymer with a polyamide.

Two-piece golf balls having covers containing block polyamide copolymers are disclosed in the prior art. For example, U.S. Pat. No. 4,234,184 to Deleens et al. discloses the use of a thermoplastic block copoly(ether-amide) as a cover material for a golf ball having a core and a cover. Deleens et al. also disclose blends of this block copolymer with minor proportions of compatible polymer(s) which are further required to have a melting point between 80° and 150° C. and a Shore D hardness from 35 to 70. Blends of this block copolymer with polyamide are not disclosed.

Several patents disclose blends of polyamide elastomers and ionomers. For example, U.S. Pat. No. 4,858,924 to Saito discloses the use of a thermoplastic resin with a flexural modulus of 1,500 to 5,000 kg/cm$^2$ as the cover of a golf ball. Particularly, polyamide elastomer, urethane elastomer, styrene-butadiene copolymer elastomer and polyester elastomer are said to be preferred when used alone or blended with a matrix resin, that is, another like flexible thermoplastic resin. The polyester elastomers are said to include block copoly(ether-esters), block copoly(lactone-esters) and aliphatic and aromatic dicarboxylic acid copolymerized polyesters. However, this reference does not teach that polyamide can be a matrix resin.

Multilayer golf balls containing block copolymers are disclosed in the prior art. For example, pertaining to covers, UK Patent Application GB 2,278,609 A discloses a three-piece golf ball with an outer or cover layer formed from a relatively soft, low modulus (1 to 10 kpsi) nonionomer TPE, such as a polyurethane (ESTANE® from B. F. Goodrich, TEXIN® from Bayer and PELLETHANE® from Dow are taught), a polyester elastomer (HYTREL® from DuPont is taught), or a polyester amide (PEBAX® from Elf Atochem S.A. is taught). Blends of these materials with polyamide are not disclosed.

Intermediate layers containing block copolymers are disclosed for multilayer golf balls. For example, U.S. Pat. No. 5,556,098 to Higuchi et al. discloses the use of a three-layer golf ball with a soft middle layer composed of a blend of a polyamide elastomer and an ionomer, such that the JIS C hardness of the blend is less than 80. The exact chemical composition or structure of the polyamide elastomer is not disclosed other than that it is said to be a thermoplastic elastomer. Higuchi et al. are silent on the flexural modulus characteristics of these blends and of their components. Furthermore, Higuchi does not disclose blends of these elastomers with polyamide.

U.S. Pat. No. 5,253,871 to Viollaz discloses the use of at least 10% of a block copoly(amide-ether) elastomer, optionally blended with an ionomer, for use as the middle layer of a three-layer golf ball. The hardness of the block copolymer is said to be within the range of 30–40 Shore D hardness while the corresponding hardness of the ionomer component is said to be between 55–65 Shore D. The overall hardness of the middle layer is said to range from 20–50 Shore D. The cover may also be a block copoly(amide-ether) and ionomer blend but its overall hardness must be greater than that of the adjacent middle layer. However, Viollaz is silent on the flexural modulus characteristics of the blends or their components. Furthermore, Viollaz does not disclose blends of these block copolymers with polyamide.

Australian patent publication No. AU-A-60631/96 discloses the use of a polyamide polymer in golf balls, but only in a three-piece golf ball. The teachings of this reference are further limited in many respects. For example, the polyamide must be present only in the intermediate layer of the three-piece golf ball and then present only in the form of a blend with certain thermoplastic elastomers. Moreover, the reference teaches that the blend comprises only 50% to 95% polyamide by weight. Styrene-butadiene-styrene block copolymer, maleic anhydride-modified styrene-butadiene-styrene block copolymer, ethylene-ethyl acrylate copolymer, and maleic anhydride-modified ethylene-ethyl acrylate copolymer are the only thermoplastic elastomers disclosed for blending with the polyamide. Furthermore, the reference teaches that these four thermoplastic elastomers must be within the JIS-A hardness range of 30 to 98. Even further, the polyamide blended with these thermoplastic elastomers is taught to have a flexural modulus between 6,000 and 30,000 kg/cm$^2$ (85 and 427 kpsi). Additionally, the resulting blended composition is disclosed to have a flexural modulus of between only 5,000 and 12,000 kg/cm$^2$ (71 and 171 kpsi).

U.S. Pat. No. 4,679,795 to Melvin et al. discloses blends of optical brighteners with the following golf ball cover materials: polyolefins and their copolymers; polyurethanes; polyamides; polyamide blends with SURLYN®, polyethylene, ethylene copolymers and EPDM; acrylic resins; thermoplastic rubbers such as urethanes, styrene block copolymers, copoly(ether-amides) and olefinic thermoplastic rubbers; thermoplastic polyesters and polyester TPEs; and blends of thermoplastic rubbers with nylon. The reference contains no teaching or suggestion, however, to form the blend without the required optical brightener component.

None of the blended compositions described above offers the combination of durability and distance provided by two-piece golf balls with ionomer covers and the high spin rate and control that is available with three-piece, wound golf balls having balata covers. Therefore, there remains a need for golf ball cores, intermediate layers and covers that comprise a polyamide, optionally blended with a nonionomer polymer, to provide one-piece, two-piece and/or multilayer golf balls with the durability and distance of a SURLYN® covered two-piece ball and the feel, click, and control of a balata covered three-piece ball.

SUMMARY OF THE INVENTION

One embodiment of the present invention relates to a golf ball comprising a cover and a core, where the cover is formed of a substantially optical brightener-free composition which comprises a blend of from about 1 wt. % to about 99 wt. % of at least one nonionomer polymer and from about 99 wt. % to about 1 wt. % of at least one polyamide polymer. Alternatively, however, in a further embodiment the substantially optical brightener-free composition comprises a blend of from about 0 wt. % to about 99 wt. % of at least one nonionomer polymer and from about 100 wt. % to about 1 wt. % of at least one polyamide polymer.

Preferred polyamide polymers include polyamide homopolymers, polyamide copolymers and mixtures thereof, where the polyamide polymer has a flexural modulus of from about 30,000 psi to about 500,000 psi, where the polyamide homopolymer is polyamide 6, polyamide 11, polyamide 12, polyamide 4,6, polyamide 6,6, polyamide 6,9, polyamide 6,10, polyamide 6,12 or mixtures thereof and where the polyamide copolymer is polyamide 6/6,6, polyamide 6,6/6,10, polyamide 6/6,T, polyamide 6/6,6/6,10 or mixtures thereof.

Nonionomer polymers useful in the invention, when present, have a flexural modulus of from about 1,000 psi to about 150,000 psi and include but are not limited to block copoly(ester-ester), block copoly(ester-ether), block copoly (amide-ester), block copoly(amide-ether), block copoly (urethane-ester), block copoly(urethane-ether), a block polystyrene thermoplastic elastomer comprising an unsaturated rubber, a block polystyrene thermoplastic elastomer comprising a functionalized substantially saturated rubber, a thermoplastic and elastomer blend comprising polypropylene and ethylene-propylene-diene monomer terpolymer or ethylene-propylene copolymer rubber where the rubber is dynamically vulcanized, poly(ethylene terephthalate), poly (butylene terephthalate), poly(trimethylene terephthalate), poly(vinyl alcohol), poly(vinyl acetate), poly(silane), poly (vinylidene fluoride), acrylonitrile-butadiene-styrene copolymer, olefinic polymers, their copolymers, including functional comonomers, and mixtures thereof.

In another embodiment the invention relates to a golf ball comprising a cover and a core, where the cover is formed of a substantially optical brightener-free composition made up of a blend of from about 15 wt. % to about 75 wt. % of at least one nonionomer polymer and from about 85 wt. % to about 25 wt. % of at least one polyamide polymer.

An additional embodiment of the present invention is a golf ball comprising a cover layer, a core layer and at least one intermediate layer interposed between the cover layer and the core layer, where at least one of the layers comprises a substantially optical brightener-free composition comprising from about 1 wt. % to about 99 wt. % of at least one nonionomer thermoplastic polymer and from about 99 wt. % to about 1 wt. % of at least one polyamide polymer. Alternately, however, in a further additional embodiment the substantially optical brightener-free composition comprises from about 0 wt. % to about 99 wt. % of at least one nonionomer thermoplastic polymer and from about 100 wt. % to about 1 wt. % of at least one polyamide polymer.

An alternate embodiment of the present invention is directed to a golf ball comprising a cover layer, a core layer and at least one intermediate layer interposed between the cover layer and the core layer, where at least one of the layers comprises a substantially optical brightener-free composition comprising from about 1 wt. % to about 99 wt. % of at least one nonionomer thermoplastic elastomer polymer and from about 99 wt. % to about 1 wt. % of at least one polyamide polymer, and where the nonionomer thermoplastic elastomer polymer is selected from the group consisting of block copoly(ester-ester), block copoly(ester-ether), block copoly(amide-ester), block copoly(amide-ether), block copoly(urethane-ester), block copoly(urethane-ether), a thermoplastic and elastomer blend comprising polypropylene and ethylene-propylene-diene monomer terpolymer or ethylene-propylene copolymer rubber where the rubber is dynamically vulcanized, and mixtures thereof A further alternate embodiment of the present invention is directed to a golf ball comprising a cover layer, a core layer and at least one intermediate layer interposed between the cover layer and the core layer, where at least one of the layers comprises a substantially optical brightener-free composition comprising from about 51 wt. % to about 99 wt. % of at least one nonionomer thermoplastic elastomer polymer and from about 49 wt. % to about 1 wt. % of at least one polyamide polymer, where the nonionomer thermoplastic elastomer polymer is selected from the group which further comprises a block polystyrene thermoplastic elastomer comprising an unsaturated rubber and a block polystyrene thermoplastic elastomer comprising a functionalized substantially saturated rubber.

An additional further alternate embodiment of the present invention is directed to a golf ball comprising a cover layer, a core layer and at least one intermediate layer interposed between the cover layer and the core layer, where at least one of the layers comprises a substantially optical brightener-free composition where the nonionomer thermoplastic elastomer polymer is selected from the group which further comprises a block polystyrene thermoplastic elastomer comprising an unsaturated rubber and a block polystyrene thermoplastic elastomer comprising a functionalized substantially saturated rubber and where the polyamide polymer is combined with an amount of the nonionomer thermoplastic elastomer sufficient to form a mixture such that the flexural modulus of the mixture is less than about 70,000 psi.

In any of the above additional embodiments and alternate embodiments, when at least one intermediate layer comprises polyamide, the cover preferably comprises at least one material selected from the group consisting of nonionic olefinic polymers, polyamide, polyolefin ionomers, styrene-butadiene-styrene ionomers, styrene-(hydrogenated butadiene)-styrene ionomers, poly(isoprene), poly (butadiene), a thermoset poly(urethane), and a thermoset poly(urea).

Another embodiment of the present invention is a golf ball comprising a cover layer, a core layer and at least one intermediate layer interposed between the cover layer and the core layer, where at least one of the layers comprises a substantially optical brightener-free composition comprising from about 15 wt. % to about 75 wt. % of at least one nonionomer thermoplastic polymer and from about 85 wt. % to about 25 wt. % of at least one polyamide polymer.

Another additional embodiment of the present invention is a golf ball comprising a cover layer, a core layer and at least one intermediate layer interposed between the cover layer and the core layer, where at least one of the layers comprises a substantially optical brightener-free composition comprising from about 15 wt. % to about 75 wt. % of at least one nonionomer thermoplastic elastomer polymer and from about 85 wt. % to about 25 wt. % of at least one polyamide polymer, and where the nonionomer thermoplastic elastomer polymer is selected from the group consisting of block copoly(ester-ester), block copoly(ester-ether), block copoly(amide-ester), block copoly(amide-ether), block copoly(urethane-ester), block copoly(urethane-ether), a thermoplastic and elastomer blend comprising polypropylene and ethylene-propylene-diene monomer terpolymer or ethylene-propylene copolymer rubber where the rubber is dynamically vulcanized, and mixtures thereof.

Another further additional embodiment of the present invention is a golf ball comprising a cover layer, a core layer and at least one intermediate layer interposed between the cover layer and the core layer, where at least one of the layers comprises a substantially optical brightener-free composition comprising from about 51 wt. % to about 75 wt. % of at least one nonionomer thermoplastic elastomer polymer and about 49 wt. % to about 25 wt. % of at least one polyamide polymer, where the nonionomer thermoplastic elastomer polymer is selected from the group which further comprises a block polystyrene thermoplastic elastomer comprising an unsaturated rubber and a block polystyrene thermoplastic elastomer comprising a functionalized substantially saturated rubber.

In a separate embodiment of the present invention, a golf ball comprising a cover layer and a core has at least one intermediate layer interposed between the cover layer and the core, where one of the layers comprises a substantially optical brightener-free composition comprising from about 1 wt. % to about 99 wt. % of at least one nonionomer thermoplastic polymer and from about 99 wt. % to about 1 wt. % of at least one polyamide polymer, and where another layer comprises a thermoset polymer. Alternatively, however, in a further separate embodiment the substantially optical brightener-free composition comprises from about 0 wt. % to about 99 wt. % of at least one nonionomer thermoplastic polymer and from about 100 wt. % to about 1 wt. % of at least one polyamide polymer.

In a further separate embodiment of the present invention, a golf ball comprising a cover layer and a core has at least one intermediate layer interposed between the cover layer and the core, where one of the layers comprises a substantially optical brightener-free composition comprising from about 1 wt. % to about 99 wt. % of at least one nonionomer thermoplastic elastomer polymer and from about 99 wt. % to about 1 wt. % of at least one polyamide polymer, where the nonionomer thermoplastic elastomer polymer is selected from the group consisting of block copoly(ester-ester), block copoly(ester-ether), block copoly(amide-ester), block copoly(amide-ether), block copoly(urethane-ester), block copoly(urethane-ether), a thermoplastic and elastomer blend comprising polypropylene and ethylene-propylene-diene monomer terpolymer or ethylene-propylene copolymer rubber where the rubber is dynamically vulcanized, and mixtures thereof, and where an other one of the layers comprises a thermoset polymer.

In an additional further separate embodiment of the present invention, a golf ball comprising a cover layer and a core has at least one intermediate layer interposed between the cover layer and the core, where one of the layers comprises a substantially optical brightener-free composition comprising from about 51 wt. % to about 99 wt. % of at least one nonionomer thermoplastic elastomer polymer and from about 49 wt. % to about 1 wt. % of at least one polyamide polymer, where the nonionomer thermoplastic elastomer polymer is selected from the group which further comprises a block polystyrene thermoplastic elastomer comprising an unsaturated rubber and a block polystyrene thermoplastic elastomer comprising a functionalized substantially saturated rubber.

Thermoset polymers useful in the invention include but are not limited to poly(isoprene), poly(butadiene), poly (urethane), poly(urea), and mixtures thereof.

The invention also relates to a method of making a golf ball, which comprises forming a golf ball core, preparing a substantially optical brightener-free composition of from about 1 wt. % to about 99 wt. % of at least one nonionomer polymer and of from about 99 wt. % to about 1 wt. % of at least one polyamide polymer, and molding the blend around the golf ball core to form the golf ball. Alternatively, however, the substantially optical brightener-free composition comprises from about 0 wt. % to about 99 wt. % of at least one nonionomer polymer and from about 100 wt. % to about 1 wt. % of at least one polyamide polymer.

The invention also further relates to a method of making a golf ball, which comprises forming a core layer, forming at least one intermediate layer about the core layer, and forming a cover layer over the at least one intermediate layer, where at least one of the layers is formed of a substantially optical brightener-free composition comprising from about 1 wt. % to about 99 wt. % of at least one nonionomer thermoplastic polymer and from about 99 wt. % to about 1 wt. % of at least one polyamide polymer. Alternatively, however, the substantially optical brightener-free composition comprises from about 0 wt. % to about 99 wt. % of at least one nonionomer thermoplastic polymer and from about 100 wt. % to about 1 wt. % of at least one polyamide polymer.

The invention also additionally relates to a method of making a golf ball, which comprises forming a core layer, forming at least one intermediate layer about the core layer, and forming a cover layer over the at least one intermediate layer, where at least one of the layers is formed of a substantially optical brightener-free composition comprising from about 1 wt. % to about 99 wt. % of at least one nonionomer thermoplastic elastomer polymer and from about 99 wt. % to about 1 wt. % of at least one polyamide polymer, and where the nonionomer thermoplastic elastomer polymer is selected from the group consisting of block copoly(ester-ester), block copoly(ester-ether), block copoly (amide-ester), block copoly(amide-ether), block copoly (urethane-ester), block copoly(urethane-ether), a thermoplastic and elastomer blend comprising polypropylene and ethylene-propylene-diene monomer terpolymer or ethylene-propylene copolymer rubber where the rubber is dynamically vulcanized, and mixtures thereof

DETAILED DESCRIPTION OF THE INVENTION

The present invention relates to golf ball forming compositions having unexpectedly improved durability, initial velocity and shear resistance. The compositions of the invention comprise at least one polyamide, in the form of a homopolymer, a copolymer or mixtures thereof. Optionally, at least one polyamide is present in the form of a blend with at least one nonionomer polymer or resin, which itself is present in the form of a nonionomer thermoplastic polymer, a nonionomer thermoplastic elastomer or mixtures thereof. As demonstrated in the appended examples, golf balls having covers, cores and/or intermediate layers incorporating the polyamide and/or polyamide-nonionomer polymer blends of the invention have unexpectedly improved durability and initial velocity when compared to golf balls formed of ionomers and ionomer blends of the prior art. The invention provides great flexibility for selecting the modulus and hardness of each of the blend components over a wider range than is possible with blends composed solely of ionomer components.

The present invention is directed to methods and compositions for use in the manufacture of golf balls, particularly, golf ball cores, covers and intermediate layers. As used herein, an "intermediate layer" is an independent layer between a cover and a core. Such an intermediate layer may be distinguished from a cover or a core by some difference in the materials comprising the layers. An intermediate layer may, for example, have a distinct composition, a different proportion of components, a different molecular weight of a component, a different molecular weight distribution of a component, or a different degree of curing or crosslinking when compared to the corresponding attribute of the component comprising the cover or core layers. Moreover, a "cover" or a "core" as these terms are used herein may comprise a single layer or a plurality of layers. An intermediate layer may be used, if desired, with a dual or a multilayer cover or a dual or a multilayer core, or with both a multilayer cover and a multilayer core. Therefore, an intermediate layer is also sometimes, referred to in the art as an inner cover layer, as an outer core layer or as a mantle layer.

The compositions of the present invention comprise polyamides and/or polyamide copolymers, such as nylons and nylon copolymers, optionally blended with nonionomer polymers, such as nonionomer thermoplastic polymers, nonionomer thermoplastic copolymers, nonionomer TPEs, and mixtures of the above nonionomers. When the compositions of the invention have no added compatibilizing component, this condition is therefore defined and referred to herein as being "substantially compatibilizer-free." Moreover, as the compositions of the invention have no added optical brightener component, this condition is therefore defined and referred to herein as being "substantially optical brightener-free."

The compositions of the invention can be used in the formation of golf ball covers and as intermediate layers for multi-layer golf balls. Further, they can be used to form covers for two-piece golf balls. The compositions of this invention can also be used to form unitary or one-piece golf balls. Additionally, they can be used to form golf ball cores for two piece or multi-layer balls.

The present invention is further directed to a method of making a golf ball core, an intermediate layer and/or a cover, optionally comprising blending one or more polyamides or one or more polyamide copolymers optionally with one or more nonionomer polymers such that there is mixing of the different polymeric components to give a blend suitable for forming into the above golf ball components.

In the case of blends, as described above, such blends may comprise about 1% to about 99% by weight of a polyamide and about 99% to about 1% by weight of a nonionomer polymer. Preferably, the blend comprises about 5% to about 95% by weight of a polyamide and about 95% to about 5% by weight of a nonionomer polymer. More preferably, the blend comprises about 10% to about 85% by weight of a polyamide and about 90% to about 15% by weight of a nonionomer polymer. Even more preferably, the blend comprises about 25% to about 85% by weight of a polyamide and about 75% to about 15% by weight of a nonionomer polymer. Most preferably, the blend comprises about 45% to about 75% by weight of a polyamide and about 55% to about 25% by weight of a nonionomer polymer.

The polymer blends of this invention can be prepared with blend components of varying molecular architecture. Examples of the parameters which may be varied include molecular weight, molecular weight distribution, tacticity and, optionally, branching, degrees and arrangements of blockiness, block molecular weight and block molecular weight distribution, as is well known to those knowledgeable in the art of blending polymers.

The polyamide component useful in forming the compositions of this invention is a thermoplastic with repeating amide groups. These are commonly known as nylons. This component can be comprised of a homopolymer, a copolymer, including a block copolymer, or a blend of two or more variations of any or all of the above types of polyamides.

Polyamide homopolymers are produced by two common methods. In the first, a compound containing one organic acid-type endgroup and one amine endgroup is formed into a cyclic monomer. The polyamide is then formed from the monomer by a ring-opening addition polymerization. These polyamides are commonly designated as polyamide 6, polyamide 11, polyamide 12, etc., where the number indicates the number of carbon atoms making up the ring in the monomer. The second method involves the condensation polymerization of a dibasic acid and a diamine. These polyamides are commonly designated as polyamide 4,6, polyamide 6,6, polyamide 6,9, polyamide 6,10, polyamide 6,12, etc., where the first number indicates the number of carbon atoms connecting the two amine groups in the diamine and the second number indicates the number of carbon atoms connecting the two acid groups in the dibasic acid, including those in the acid groups.

Preferred polyamide homopolymers include polyamide 4, polyamide 6, polyamide 7, polyamide 11, polyamide 12, polyamide 13, polyamide 4,6, polyamide 6,6, polyamide 6,9, polyamide 6,10, polyamide 6,12, polyamide 12,12, polyamide 13,13 and mixtures thereof. More preferred polyamide homopolymers include polyamide 6, polyamide 11, polyamide 12, polyamide 4,6, polyamide 6,6, polyamide 6,9, polyamide 6,10, polyamide 6,12 and mixtures thereof. The most preferred polyamide homopolymers are polyamide 6, polyamide 11, polyamide 12 and mixtures thereof.

Polyamide copolymers are produced by several common methods. First, they are produced from addition polymerization by using two or more cyclic monomers with different numbers of carbon atoms making up each monomeric ring. Alternatively, polyamide copolymers are produced from condensation polymerization by using a single dibasic acid and two or more different diamines, each with a different number of carbon atoms separating the two amine groups, by using a single diamine and two or more different dibasic acids, each with a different number of carbon atoms separating the two acid groups, or by using two or more different diamines and dibasic acids. Additionally, polyamide copolymers are produced by blending two or more polyamide melts and holding the materials in the molten state for a sufficient time period such that partial or full randomization occurs. Polyamide copolymers are commonly designated by the separating the symbols for the homopolymers by the symbol "/". For the purposes of this application, the component named first can be either the major or a minor component of the copolymer.

Preferred polyamide copolymers include polyamide 6/6, 6, polyamide 6,6/6,10, polyamide 6/6,T wherein T represents terephthalic acid, polyamide 6/6,6/6,10 and mixtures thereof.

The polyamide component of this invention has a Shore D hardness of at least about 50, as measured by ASTM method D-2240, a flexural modulus, as measured by ASTM method D-790, of at least about 30,000 psi, preferably from about 30,000 psi to about 500,000 psi, more preferably from about 50,000 psi to about 500,000 psi, and a melt index from about 0.5 to about 100 g/10 min, as measured by ASTM method D-1238, condition E using a 2.16 kg weight.

In another embodiment of the present invention, at least one polyamide polymer is combined with at least one nonionomer polymer according to methods well known in the art for combining materials for use in golf ball compositions. In particular, the polyamide polymers of the invention may be combined with any other nonionomer TPE polymer or nonionomer thermoplastic polymer that is or can be used in golf ball covers. As used herein, a nonionomer thermoplastic polymer is exclusive of a nonionomer thermoplastic elastomer (TPE) polymer in that, as one of ordinary skill in the art would recognize, a nonionomer thermoplastic elastomer polymer exhibits the typical mechanical response, not of a thermoplastic, but of an elastomer. For example, a nonionomer thermoplastic elastomer polymer should stretch rapidly and considerably under tension, reach high elongations with low damping, i.e., little loss of energy as heat, and should retract rapidly from high elongations, exhibiting the phenomenon of snap or rebound. The present invention also contemplates the use of a variety of materials blended with at least one polyamide to form golf ball compositions. In particular, the core and/or layer(s) of the present invention may comprise a nonionomer thermoplastic elastomer. TPEs possess the material and mechanical properties characteristic of an elastomer but, unlike an elastomer, can be processed like a thermoplastic because they exhibit a melting point, which is a characteristic of a thermoplastic. Therefore, a TPE may substitute for an elastomer in imparting desirable rubber properties to a polymer blend while simultaneously maintaining many of the desirable advantages of a thermoplastic during processing, such as low cost fabrication, recyclability of scrap, and rapid, continuous, automated processing.

Generally, TPEs consist of at least two polymer types or phases, each of which has a characteristic softening temperature. One phase is selected to be above its softening point at the use temperature, thereby providing rubbery response, while the other phase is selected to be below its softening point at the use temperature, thereby anchoring the soft material in a manner analogous to the crosslink points of a conventional crosslinked rubber. However, unlike crosslinked rubber, the anchoring effect is reversible and can be removed by heating the TPE to an elevated temperature above both softening points. At the elevated temperature, conventional thermoplastic processing methods are possible. Subsequent cooling to below the upper softening point allows the anchoring effect to be reestablished.

The two polymer types or phases are often chemically joined or bonded to give a block copolymer molecular architecture, but this is not a requirement for exhibiting the typical TPE behavior described above. Mechanical mixing of two polymer types or in situ polymerization or grafting may also result in TPE-like response. A list of 19 discrete chemical types of TPEs is available in Table 2 of the "Kirk-Othmer Encyclopedia of Chemistry and Technology", 4th Ed., Vol. 9, p. 18 (1994).

The preferred nonionomer TPEs of this invention can be characterized by chemical composition to comprise the following categories: (1) block copoly(ester) copolymers (2) block copoly(amide) copolymers (3) block copoly(urethane) copolymers, (4) styrene-based block copolymers, (5) thermoplastic and elastomer blends wherein the elastomer is not vulcanized (hereafter "TEB") and (6) thermoplastic and elastomer or rubber blends wherein the elastomer is dynamically vulcanized (hereafter "TEDV").

Block copoly(ester) copolymer TPEs (1) comprise alternating blocks of a polyester oligomer, for example polyalkylene terephthalate (material with the higher softening point), wherein the alkylene group is typically 1,4-butylene, and another block with a lower softening point. Optionally, the block copoly(ester) copolymer can be partially comprised of at least one thioester. Still further, the block copoly(ester) copolymer TPE can optionally be a block copoly(thioester) copolymer.

If the lower softening point material of the block copoly (ester) copolymer is an ester, for example, a polylactone such as polycaprolactone, then block copoly(ester-esters) result. If the lower softening point material is a polyether oligomer, for example, a polyalkylene ether, then block copoly(ester-ethers) result. If the lower softening point material is a polythioether oligomer, for example, a polythioalkylene ether, then block copoly(ester-thioethers) result. If the lower softening point material is an α,ω-hydroxybutadiene oligomer such as the POLYBD® resins available from Elf Atochem S.A., optionally at least partially hydrogenated, then block copoly(ester-α,ω-hydroxybutadienes) result. Optionally, the lower softening point material may comprise a mixture, for example, a mixture of any of the above-mentioned lower softening point materials, e.g., polyalkylene ethers such as propylene ether and butylene ether, or a mixture of a polyalkylene ether and a polythioalkylene ether. Furthermore, such mixtures of lower softening point materials may be present in a random or block arrangement, or as mixtures thereof Preferably, the block copoly(ester) copolymer TPE is a block copoly(ester-ester), a block copoly(ester-ether), or mixtures thereof. More preferably, the block copoly(ester) copolymer TPE is at least one block copoly(ester-ether) or mixtures thereof. Suitable commercially available TPE copoly(ester-ethers) include the HYTREL® series from DuPont, which includes HYTREL® 3078, G3548W, 4056, G4078W and 6356; the LOMOD® series from General Electric, which includes LOMOD® ST3090A and TE3055A; ARNITEL® and URAFIL® from Akzo; ECDEL® from Eastman Kodak; and RITEFLEX® from Hoechst Celanese.

Block copoly(amide) copolymer TPEs (2) comprise alternating blocks of a polyamide oligomer (material with the higher softening point) and another block with a lower softening point. Block copoly(amides) are described more fully in U.S. Pat. No. 4,331,786 to Foy et al. which is herein incorporated by reference in its entirety. Optionally, the block copoly(amide) copolymer can be partially comprised of at least one thioamide. The block copoly(amide) copolymer TPE can optionally be a block copoly(thioamide) copolymer.

If the lower softening point material of the block copoly (amide) copolymer is, e.g., a polyether oligomer or a polyalkylene ether, for example, poly(ethylene oxide), then block copoly(amide-ethers) result. If the lower softening point material of the block copoly(amide) copolymer is an ester, for example, a polylactone such as polycaprolactone, then block copoly(amide-esters) result. Any of the lower softening point materials cited in the description of the block copoly(ester) copolymers above may be used to form a block copoly(amide) copolymer. Optionally, the lower softening point material of the block copoly(amide) copolymer may comprise a mixture, for example, a mixture of any of the above-mentioned lower softening point materials. Furthermore, said mixtures of lower softening point materials may be present in a random or block arrangement, or as mixtures thereof.

Preferably, the block copoly(amide) copolymer TPE is a block copoly(arnide-ester), a block copoly(amide-ether), or mixtures thereof. More preferably, the block copoly(amide) copolymer TPE is at least one block copoly(amide-ether) or mixtures thereof. Suitable commercially available thermoplastic copoly(amide-ethers) include the PEBAX® series from Elf-Atochem, which includes PEBAX® 2533, 3533, 4033 and 6333; the GRILAMID® series by Emser, which includes Ely 60; and VESTAMID® and VESTENAMER® by Hüls.

Block copoly(urethane) copolymer TPEs (3) comprise alternating blocks of a polyurethane oligomer (material with the higher softening point) and another block with a lower softening point. The polyurethane block comprises a diisocyanate, typically 4,4'-diphenylmethane diisocyanate, 4,4'-dicyclohexylmethane diisocyanate, 2,4-toluene diisocyanate, 2,6-toluene diisocyanate, para-phenylene diisocyanate or mixtures thereof, chain extended with a diol such as 1,4-butanediol, a dithiol such as 1,4-butanedithiol, a thio-substituted alcohol, such as 1-thiolbutane-4-ol, or mixtures thereof. Optionally, the block copoly(urethane) copolymer can be at least partially comprised of at least one dithioisocyanate.

If the lower softening point material of the block copoly (urethane) copolymer is, e.g., a polyether oligomer or a polyalkylene ether, for example, poly(ethylene oxide), then block copoly(urethane-ethers) result. If the lower softening point material of the block copoly(urethane) copolymer is an ester, for example, a polylactone such as polycaprolactone, then block copoly(urethane-esters) result. Any of the lower softening point materials cited in the description of the block copoly(ester) copolymers above may be used to form a block copoly(urethane) copolymer. Optionally, the lower softening point material of the block copoly(urethane) copolymer may comprise a mixture, for example, a mixture of any of the above-mentioned lower softening point materials. Furthermore, said mixtures of lower softening point materials may be present in a random or block arrangement, or as mixtures thereof.

Preferably, the block copoly(urethane) copolymer TPE is a block copoly(urethane-ester), a block copoly(urethane-ether), or mixtures thereof. Examples of suitable commercially available thermoplastic polyurethanes include the ESTANE® series from the B. F. Goodrich Company, which includes ESTANE® 58133, 58134, 58144 and 5831 1; the PELLETHANE® series from Dow Chemical, which includes PELLETHANE® 2102-90A and 2103-70A; ELASTOLLAN® from BASF; DESMOPAN® and TEXIN® from Bayer; and Q-THANE® from Morton International.

Block polystyrene TPEs (4) comprise blocks of polystyrene or substituted polystyrene, e.g. poly(α-methyl styrene)

or poly(4-methyl styrene), (material with the higher softening point) chemically linked or joined to the ends of lower softening point blocks of either a rubber with unsaturation or a saturated rubber. Unsaturated rubber types typically include butadiene, to form styrene-butadiene-styrene (hereafter "SBS"), or isoprene, to form styrene-isoprene-styrene (hereafter "SIS") block copolymers. Examples of suitable commercially available thermoplastic SBS or SIS copolymers include the KRATON® D series from Shell Chemical, which includes KRATON® D2109, D5119 and D5298; VECTOR® from Dexco; and FINAPRENE® from Fina Oil and Chemical.

Alternatively, the polystyrene blocks of polystyrene TPEs are joined to the ends of substantially saturated rubber blocks. Saturated rubber types typically include butyl rubber or hydrogenated butadiene. The latter styrene-(hydrogenated butadiene)-styrene TPEs, wherein the degree of hydrogenation may be partial or substantially complete, are also known as SEBS. Additionally, copolymers of ethylene and propylene or ethylene and butylene can be chemically linked to polystyrene blocks to form styrene-copolyethylene-styrene (hereafter "SES"). Examples of suitable commercially available thermoplastic SES copolymers include the KRATON® G series from Shell Chemical, which includes KRATON® G2705, G7702, G7715 and G7720; SEPTON® from Kuraray; and C-FLEX® from Concept.

Additionally, block polystyrene TPEs may be functionalized with polar moieties by performing maleic anhydride or sulfonic grafting. Examples of commercially available styrene-block elastomers functionalized by grafting include the KRATON® series from the Shell Corporation, which includes KRATON® FG1901X and FG1921X. Furthermore, block polystyrene TPEs may be functionalized with hydroxy substitution at the polymer chain ends. An example of a commercially available styrene-block elastomer functionalized by hydroxy termination is SEPTON® HG252 from the Mitsubishi Chemical Company.

Preferably, the block polystyrene TPE comprises an unsaturated rubber, a functionalized substantially saturated rubber, or mixtures thereof. More preferably, the block polystyrene TPE comprises an unsaturated rubber functionalized by grafting with maleic anhydride, an unsaturated rubber functionalized by hydroxy termination, a substantially saturated rubber functionalized by grafting with maleic anhydride, a substantially saturated rubber functionalized by hydroxy termination, or mixtures thereof. Most preferably, the block polystyrene TPE comprises SBS or SIS functionalized by grafting with maleic anhydride, SEBS or SES functionalized by grafting with maleic anhydride, or mixtures thereof Unlike the previous four groups of TPEs, wherein the components are linked chemically, the TEB and the TEDV groups are commonly prepared by blending a relatively harder thermoplastic and a relatively softer polymer, which functions like an elastomer. Blending is usually accomplished by mechanical mixing of the two polymer types but in situ polymerization or grafting may also be employed. At the completion of blending, the two polymer components form a finely interdispersed multiphase morphology which is optionally linked by covalent chemical bonds. The dispersion is fine enough such that the resulting blend has the mechanical properties and performance typically expected of a TPE. Typically, the harder polymer is the continuous phase since it is usually present in greater quantity. These blended TPEs can be further characterized by whether the softer, elastomeric component is intentionally vulcanized or substantially free of crosslinks.

The TEBs (5) are comprised of thermoplastic and elastomer blends wherein the elastomer is not intentionally crosslinked or vulcanized. The harder polymer component is typically a polyolefin or halogenated polyolefin, preferably comprising propylene units, or polyvinylchloride. The softer or elastomeric polymer is typically an ethylene-propylene-diene monomer terpolymer (hereafter "EPDM"), ethylene-propylene copolymer rubber (hereafter "EPR") or nitrile rubber. Suitable TEBs include TELCAR® from Teknor Apex, which includes TELCAR 302; TPR® from Advanced Elastomer Systems; REN-FLEX® from Dexter; and POLYTROPE® from Schulman.

The second group of thermoplastic and elastomer blends, the TEDVs (6), are comprised of thermoplastic and elastomer or rubber blends wherein the elastomer is intentionally crosslinked or dynamically vulcanized. This terminology arises because, in typical TEDV blending processes, the elastomer phase is intentionally crosslinked or vulcanized while the melt is subjected to intense shearing fields during blending, in contrast to the quiescent conditions usually present when rubber is vulcanized. The harder polymer component of a TEDV is typically identical to those used in TEBs. The softer or elastomeric polymer of a TEDV is usually natural, nitrile or butyl rubber or EPDM. Suitable TEDVs include SANTOPRENE®, VYRAM® and TREFSIN® from Advanced Elastomer Systems, which includes SANTOPRENE® 101-73 and 203-40 and TREFSIN® 3201-60; the SARLINK® 2000 and 3000 series from DSM; and TELPRENE® from Teknor Apex.

Preferably, the TEDV comprises polypropylene and EPDM; polypropylene and EP rubber; polypropylene, EPDM and EP rubber; or mixtures thereof. The nonionomer TPE component of this invention has a Shore A hardness of at least about 60 or a Shore D hardness of at least about 20, as measured by ASTM method D-2240. Preferably, the Shore D hardness is from about 20 to about 75, more preferably from about 25 to about 55. The nonionomer TPE component of this invention has a flexural modulus, as measured by ASTM method D-790, of at least about 1,000 psi, preferably from about 1,000 psi to about 150,000 psi, more preferably from about 1,000 psi to about 85,000 psi.

Other nonionomer polymers which can be blended with the polymers of the claimed invention in forming golf ball compositions can be described as nonionomer thermoplastics. In particular, the core and/or layer(s) of the present invention may comprise a nonionomer thermoplastic polymer which is a thermoplastic or an engineering plastic such as: polycarbonate; polyphenylene oxide; imidized, amino group containing polymers; high impact polystyrene (hereafter "HIPS"); polyether ketone; polysulfone; poly (phenylene sulfide); reinforced engineering plastics; acrylic-styrene-acrylonitrile; poly(tetrafluoroethylene); poly(butyl acrylate); poly(4-cyanobutyl acrylate); poly(2-ethylbutyl acrylate); poly(heptyl acrylate); poly(2-methylbutyl acrylate); poly(3-methylbutyl acrylate); poly(N-octadecylacrylamide); poly(octadecyl methacrylate); poly (4-dodecylstyrene); poly(4-tetradecylstyrene); poly (ethylene oxide); poly(oxymethylene); poly(silazane); poly (furan tetracarboxylic acid diimide); poly(acrylonitrile); poly($\alpha$-methylstyrene); as well as the classes of polymers to which they belong and their copolymers, including functional comonomers; and blends thereof.

In addition, the nonionomer thermoplastic polymer may be a nonionomer olefinic polymer, i.e., a nonionomer polymer comprising an olefin. The olefinic polymers useful in the invention may be polymers formed with the use of metallocene catalyst technology, and, thus, for the purpose of this application these polymers are also referred to as metallocene catalyzed polymers, copolymers, terpolymers and tetrapolymers. Metallocene catalyzed polymers may also comprise functional groups such as epoxy, anhydride, amine, oxazoline, sulfonic acid, carboxylic acid and their salts.

As used herein, the term "olefinic polymer" means a polymer, copolymer, terpolymer or tetrapolymer comprised of at least one olefin with attached linear or branched alkyl groups having from about 1 to about 18 carbon atoms. The term "olefinic polymer" is specifically meant to include the following materials: a polymer comprising an α-olefin containing from 2 to 10 carbon atoms; polymers formed with the use of metallocene catalysts and comprising monomers selected from the group consisting of butene, hexene, and octene; polymers formed with the use of metallocene catalysts and selected from the group consisting of a copolymer of ethylene and butene, a copolymer of ethylene and hexene and a copolymer of ethylene and octene; a terpolymer formed with the use of metallocene catalysts and consisting essentially of a polymer of ethylene, propylene, and a diene monomer; copoly(ethylene-vinyl alcohol); a copolymer consisting essentially of an α-olefin monomer containing from 2 to 10 carbon atoms and an alkyl acrylate or an alkyl alkylacrylate monomer, wherein each alkyl group ranges, independently, from methyl to decyl inclusive and may be linear or branched; a copolymer consisting essentially of an α-olefin monomer containing from 2 to 10 carbon atoms and a glycidyl acrylate or a glycidyl alkylacrylate monomer, wherein the alkyl group ranges from methyl to decyl inclusive and may be linear or branched; a terpolymer consisting essentially of an α-olefin monomer containing from 2 to 10 carbon atoms, an alkyl acrylate or an alkyl alkylacrylate monomer, and a glycidyl acrylate or a glycidyl alkylacrylate monomer, wherein each alkyl group ranges, independently, from methyl to decyl inclusive and may be linear or branched; a copolymer consisting essentially of an α-olefin monomer containing from 2 to 10 carbon atoms and a vinyloxazoline or 1-alkyl vinyloxazoline monomer, wherein the alkyl group ranges from methyl to decyl inclusive and may be linear or branched; a terpolymer consisting essentially of an α-olefin monomer containing from 2 to 10 carbon atoms, an alkyl acrylate or an alkyl alkylacrylate monomer, and a vinyloxazoline or 1-alkyl vinyloxazoline monomer, wherein each alkyl group ranges, independently, from methyl to decyl inclusive and may be linear or branched; a copolymer consisting essentially of an α-olefin monomer containing from 2 to 10 carbon atoms and carbon monoxide; a terpolymer consisting essentially of a first α-olefin monomer containing from 2 to 10 carbon atoms, a second α-olefin monomer containing from 2 to 10 carbon atoms, and carbon monoxide; a copolymer consisting essentially of an α-olefin monomer containing from 2 to 10 carbon atoms and sulfur dioxide; a terpolymer consisting essentially of a first α-olefin monomer containing from 2 to 10 carbon atoms, a second α-olefin monomer containing from 2 to 10 carbon atoms, and sulfur dioxide; a copolymer consisting essentially of an α-olefin monomer containing from 2 to 10 carbon atoms and maleic anhydride; a terpolymer consisting essentially of an α-olefin monomer containing from 2 to 10 carbon atoms, maleic anhydride, and carbon monoxide; a terpolymer consisting essentially of an α-olefin monomer containing from 2 to 10 carbon atoms, maleic anhydride, and sulfur dioxide; and a terpolymer consisting essentially of an α-olefin monomer containing from 2 to 10 carbon atoms, maleic anhydride, and an alkyl acrylate or an alkyl alkylacrylate monomer, wherein each alkyl group ranges, independently, from methyl to decyl inclusive and may be linear or branched.

Any of the olefinic polymers may also be functionalized by grafting with, e.g., maleic anhydride. Furthermore, the term "olefinic polymers" also encompasses mixtures of at least two olefinic polymers.

As used herein, the phrase "linear or branched alkyl groups of up to about 18 carbon atoms" means any substituted or unsubstituted acyclic carbon-containing compound, including alkanes, alkenes and alkynes. As used herein, the phrase "alkyl group ranges from methyl to decyl inclusive and may be linear or branched" means any substituted or unsubstituted acyclic carbon-containing compounds, including alkanes, alkenes and alkynes.

Examples of alkyl groups include lower alkyl, for example, methyl, ethyl, n-propyl, iso-propyl, n-butyl, iso-butyl or tert-butyl; upper alkyl, for example, octyl, nonyl, decyl, and the like; and lower alkylene, for example, ethylene, propylene, butylene, butyldiene, pentene, hexene, heptene, octene, norbornene, nonene, decene and the like. The ordinary skilled artisan is familiar with numerous linear and branched alkyl groups, which are within the scope of the present invention.

Additionally, such alkyl groups may also contain various substituents in which one or more hydrogen atoms has been replaced by a functional group. Functional groups include but are not limited to hydroxyl, amino, epoxy, carboxyl, sulfonic amide, ester, ether, phosphates, thiol, nitro, silane and halogen (fluorine, chlorine, bromine and iodine), to mention but a few.

The copolymers formed with the use of metallocene catalysts useful in the present invention are commercially available under the trade name AFFINITY® polyolefin plastomers and ENGAGE® polyolefin elastomers by DuPont-Dow Elastomers Company and they are described more fully in U.S. Pat. Nos. 5,272,236 and 5,278,272 which are herein incorporated by reference in their entirety. Other commercially available polymers formed with the use of metallocene catalysts can be used, such as Exxon Chemical Company's EXACT® and Dow Chemical's INSIGHT® lines of resins, which have superior flexibility and clarity as well as toughness. The EXACT® and INSIGHT® lines of polymers also have novel rheological behavior in addition to their other properties as a result of using a metallocene catalyst technology. The method of making EXACT® and INSIGHT® polymers and their compositions are more fully detailed in U.S. Pat. Nos. 5,359,015 and 5,281,679.

Preferably, the nonionomer thermoplastic blended with polyamide is poly(ethylene terephthalate), such as EKTAR® available from Eastman Kodak; poly(butylene terephthalate); poly(trimethylene terephthalate), such as is available from Shell Chemical; poly(vinyl alcohol); poly (vinyl acetate); poly(silane); poly(vinylidene fluoride); acrylonitrile-butadiene-styrene copolymer (hereafter "ABS"); a copolymer consisting essentially of a styrene or an α-alkyl styrene monomer and a vinyloxazoline or a 1-alkyl vinyloxazoline monomer, wherein the alkyl groups range, independently, from methyl to decyl inclusive and may be linear or branched; a terpolymer consisting essentially of a styrene or an α-alkyl styrene monomer, an alkyl acrylate or an alkyl alkylacrylate monomer, and a vinyloxazoline or a 1-alkyl vinyloxazoline monomer, wherein the alkyl groups range, independently, from methyl to decyl inclusive and may be linear or branched; olefinic polymers; and their copolymers, including functional comonomers; and blends thereof.

More preferably, the nonionomer thermoplastic blended with polyamide is an ethylene or propylene based homopolymer or copolymer (including functional monomers such as acrylic and methacrylic acid, such as the ethylene-methyl acrylate or ethylene-butyl acrylate copolymer series available from Quantum Chemical); polymers formed with the use of metallocene catalysts and consisting essentially of a copolymer of ethylene and butene, a copolymer of ethylene and hexene or a copolymer of ethylene and octene; a terpolymer formed with the use of metallocene catalysts and consisting essentially of a polymer of ethylene, propylene and a diene monomer; poly(methyl acrylate); poly(methyl methacrylate); ABS; a polymer comprising an alkyl acrylate or an alkyl alkylacrylate, wherein each alkyl group ranges, independently, from methyl to decyl inclusive and may be linear or branched; a polymer comprising an α-olefin containing from 2 to 10 carbon atoms; and their copolymers, including functional comonomers; and blends thereof.

If desired, the nonionomer thermoplastic blended with the polyamide comprises an impact modifier or a toughened or impact-modified material, such as ABS, or preferably HIPS.

The nonionomer thermoplastic component of this invention has a Shore D hardness of at least about 20, preferably from about 20 to about 75, more preferably from about 25 to about 55, as measured by ASTM method D-2240, and a flexural modulus, as measured by ASTM method D-790, of at least about 1,000 psi, preferably from about 1,000 psi to about 150,000 psi, more preferably from about 1,000 psi to about 85,000 psi.

In an alternative embodiment, an intermediate layer in a golf ball constructed according to the invention can be about 1 wt. % up to about 100 wt. % polyamide. In this embodiment, the cover comprises a nonionomer polymer material, an ionomer, or mixtures thereof. The nonionomer polymer material may be a nonionomer thermoplastic polymer or a nonionomer TPE polymer as has been previously described, including a functionalized polymer, a copolymer or a functionalized copolymer, or mixtures thereof, or a thermoset polymer, including a functionalized thermoset polymer, a thermoset copolymer or a functionalized thermoset copolymer, or mixtures thereof. For the purposes of this application, a thermoset polymer includes, but is not limited to: poly(isoprene), both natural and synthetic; poly (butadiene); poly(chloroprene); poly(urethane); poly (siloxane); styrene-butadiene rubber; EPDM rubber; nitrile rubber; butyl rubber; chlorotrifluoroethylene copolymer rubber; vinylidene fluoride-hexafluoropropylene copolymer rubber; polysulfide rubber; epichlorohydrin rubber; poly (urea); poly(ester); phenolic resin; epoxy resin; and any nonionomer thermoplastic polymer which may be crosslinked.

When an intermediate layer in a golf ball constructed according to the invention comprises polyamide, the cover may also comprise at least one ionomer. The ionomer useful in the construction described above may be an ionomer or a functionalized ionomer, a copolymer ionomer or a functionalized copolymer ionomer, or mixtures thereof, that comprises, but is not limited to: polyolefin, polyester, copoly (ether-ester), copoly(ester-ester), polyamide, polyether, polyurethane, polyacrylate, polystyrene, SBS, SEBS, and polycarbonate, in the form of a homopolymer, a copolymer or a block copolymer ionomer.

For the purposes of this application, an ionomer is a polymer which comprises acidic groups, such as carboxylate or sulfonate, or basic groups, such as quaternary nitrogen, the acidic or basic groups being at least partially neutralized with a conjugate acid or base. Negatively charged acidic groups, such as carboxylate or sulfonate, may be neutralized with a cation, such as a metal ion. Positively charged basic groups, such as quaternary nitrogen, may be neutralized with an anion, such as a halide, an organic acid, or an organic halide. Acidic or basic groups may be incorporated into an ionomer through copolymerization of an acidic or basic monomer, such as alkyl (meth)acrylate, with at least one other comonomer, such as an olefin, styrene or vinyl acetate, followed by at least partial neutralization to form an ionomer. Alternatively, acidic or basic groups may be incorporated into a polymer to form an ionomer by reacting the polymer, such as polystyrene or a polystyrene copolymer including a block copolymer of polystyrene, with a functionalizing reagent, such as a carboxylic acid or sulfonic acid, followed by at least partial neutralization.

In particular, the ionomer may comprise a so-called "high acid" ionomer, for example, a copolymer of an olefin, e.g. ethylene, and at least 16 wt. % of an α,β-ethylenically unsaturated carboxylic acid, e.g. acrylic or methacrylic acid, wherein about 10% to about 90% of the carboxylic acid groups are neutralized with a metal ion, e.g. zinc, sodium, magnesium or lithium. Preferably, the high acid ionomer is a copolymer of ethylene and about 17–20 wt. % methacrylic acid wherein about 35% to about 65% of the carboxylic acid groups are neutralized by sodium. Examples of commercially available high acid ionomers include SURLYN® 8140, which is an ethylene-based ionomer believed to comprise 17–20 wt. % methacrylic acid and to be neutralized with sodium, and SURLYN® AD 8546 (SEP671), which is an ionomer believed to comprise 17–20 wt. % methacrylic acid and to be neutralized with lithium.

Preferably, when an intermediate layer in a golf ball constructed according to the invention comprises polyamide, the cover comprises at least one material selected from the group consisting of nonionomer polymer materials and ionomers.

More preferably, when an intermediate layer in a golf ball constructed according to the invention comprises polyamide, the cover comprises an ionomer comprising at least one material selected from the group consisting of: polyolefin, polyester, polystyrene, SBS, SEBS and polyurethane, in the form of a homopolymer, a copolymer or a block copolymer ionomer.

More preferably, when an intermediate layer in a golf ball constructed according to the invention comprises polyamide, the cover comprises a nonionomer polymer material comprising at least one material selected from the group consisting of: nonionic olefinic homopolymers and copolymers; polyamide; poly(methyl acrylate); poly(methyl methacrylate); ABS; poly(urethane); poly(urea); poly (isoprene); and poly(butadiene).

Most preferably, when an intermediate layer in a golf ball constructed according to the invention comprises polyamide, the cover comprises at least one material selected from the group consisting of: nonionic olefinic polymers; polyamide; polyolefin ionomers; SBS ionomers; SEBS ionomers; poly(isoprene); poly(butadiene); a thermoset poly(urethane) such as those described by U.S. Pat. No. 5,334,673, the contents of which are incorporated herein in their entirety; and a thermoset poly(urea) such as those described by U.S. Pat. No. 5,484,870, the contents of which are incorporated herein in their entirety.

In a further alternative embodiment, a cover layer, an intermediate layer, and/or a core or core layer in a golf ball comprising a composition according to the invention can be present in the form of a foamed polymeric material. The use of a foamed polymer allows the golf ball designer to adjust the density or mass distribution of the ball to adjust the angular moment of inertia, and, thus, the spin rate and performance of the ball. Foamed materials also offer a potential cost savings due to the reduced use of polymeric material.

Either injection molding or compression molding may be used to form a layer or a core comprising a foamed polymeric material. For example, a composition of the present invention can be thermoformed and, thus, can be compression molded. Alternatively, when the layer or the core is injection molded from a composition of the present invention, a physical or chemical blowing or foaming agent may be included to produce a foamed layer. Blowing or foaming agents useful include but are not limited to organic blowing agents, such as azobisformamide; azobisisobutyronitrile; diazoaminobenzene; N,N-dimethyl-N,N-dinitroso terephthalamide;

N,N-dinitrosopentamethylene-tetramine; benzenesulfonyl-hydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenyl-methyl-uranthan; p-sulfonhydrazide; peroxides; and inorganic blowing agents such as ammonium bicarbonate and sodium bicarbonate. A gas, such as air, nitrogen, carbon dioxide, etc., can also be injected into the composition during the injection molding process.

Additionally, a foamed composition of the present invention may be formed by blending microspheres with the composition either during or before the molding process. Polymeric, ceramic, metal, and glass microspheres are useful in the invention, and may be solid or hollow and filled or unfilled. In particular, microspheres up to about 1000 micrometers in diameter are useful.

Additional materials conventionally included in golf ball cover compositions may be added to the compositions of the invention to enhance the formation of golf ball covers. These additional materials include, but are not limited to, dyes, whitening agents, UV absorbers, processing aids, metal particles, such as metal flakes, metal powders and mixtures thereof, and other conventional additives. Antioxidants, stabilizers, softening agents, plasticizers, including internal and external plasticizers, impact modifiers, toughening agents, foaming agents, fillers, reinforcing materials and compatibilizers can also be added to any composition of the invention. All of these materials, which are well known in the art, are added for their usual purpose in typical amounts.

Nucleating agents may optionally be added to the polyamide component or to a blend comprising polyamide. They are thought to be able to beneficially alter the properties of a polyamide component which is not amorphous by changing its semicrystalline nature, such as its degree of crystallinity and the distribution of crystallite sizes. A nucleating agent typically leads to greater uniformity in the rate of crystal growth and in the size, number and type of crystals formed from the molten polyamide. The more uniform crystalline texture produced by the added nucleating agent may result in increased flexural modulus and hardness. Nucleating agents such as finely dispersed silicas may be added in typical amounts, as is known to those with skill in the art.

The compositions of the invention can be reinforced by blending with a wide range of fillers, e.g., glass fibers, inorganic particles and metal particles, as is known to those with skill in the art.

The blends of the invention are formed by combining the polymer components by methods familiar to those in the polymer blending art, for example, with a two roll mill, a Banbury mixer or a single or twin-screw extruder. The single screw extruder may optionally have a grooved barrel wall, comprise a barrier screw or be of a shortened screw design. The twin screw extruder may be of the counter-rotating non-intermeshing, co-rotating non-intermeshing, counter-rotating fully intermeshing or co-rotating fully intermeshing type. Preferably, the normally higher-melting polyamide component is first melted in the main extruder and the molten nonionomer component is introduced as a side-stream into a main extruder conveying molten polyamide where the two melts are intermixed to form a blend.

Conventional equipment used in the production of golf balls may be used to form the golf balls of the invention in a manner well known to those skilled in the art. For example, golf balls comprising the cover compositions of the invention can be made by injection molding cover stock formed from a polyamide-nonionomer blend of the invention around a core or by compression molding pre-formed half-shells of the cover stock into a ball mold in a conventional manner. Furthermore, golf ball intermediate layers comprising the intermediate layer compositions of the invention can be made by injection molding intermediate layer stock formed from a polyamide-nonionomer blend of the invention around a core or by compression molding pre-formed half-shells of the intermediate layer stock into a ball mold in a conventional manner, then covered by a layer comprising cover stock as described above, to form a multilayer golf ball.

After molding, golf balls comprising the golf ball compositions of the invention can be finished by buffing, painting, and stamping.

The properties such as hardness, modulus, core diameter, intermediate layer thickness and cover layer thickness of the golf balls of the present invention have been found to effect play characteristics such as spin, initial velocity and feel of the present golf balls.

In particular, the diameter of the core of the present invention is from about 1.200 inches to about 1.630 inches. Preferably the diameter of the core is from about 1.300 inches to about 1.600 inches. More preferably, the diameter of the core is from about 1.390 inches to about 1.580 inches. The thickness of an intermediate layer of the invention, when present, is from about 0.0020 inches to about 0.100 inches. Preferably, the thickness of the intermediate layer is from about 0.030 inches to about 0.090 inches. More preferably, the thickness of the intermediate layer is from about 0.020 inches to about 0.090 inches. Most preferably, the thickness of the intermediate layer is from about 0.030 inches to about 0.060 inches. Furthermore, the thickness of the cover layer of the present invention is from about 0.030 inches to about 0.120 inches. Preferably, the thickness of the cover layer is from about 0 .040 inches to about 0.100 inches. Most preferably, the thickness of the cover layer is from about 0.050 inches to about 0.090 inches. Preferably, the overall diameter of the core and all intermediate layers is from about 80% to about 98% of the overall diameter of the finished ball, and is preferably from about 1.680 inches to about 1.780 inches.

The present multilayer golf ball can have an overall diameter of any size. Although the United States Golf Association (hereafter "USGA") Rules of Golf limit the minimum size of a competition golf ball to 1.680 inches in diameter, there is no specification as to the maximum diameter. Moreover, golf balls of any size can be used for recreational play. The preferred diameter of the present golf balls is from about 1.680 inches to about 1.800 inches. The more preferred diameter is from about 1.680 inches to about 1.760 inches. The most preferred diameter is from about 1.680 inches to about 1.740 inches.

Several physical properties such as hardness and modulus of the various layers of the golf balls of the present invention are believed to impact the playing characteristics of such golf balls. For example, the flexural and/or tensile modulus of the intermediate layer are believed to have an effect on the "feel" of the golf balls of the present invention. Accordingly, it is preferable that the golf balls of the present invention have an intermediate layer with a flexural modulus of from about 500 psi to about 500,000 psi. More preferably, the flexural modulus of the intermediate layer is from about 1,000 psi to about 250,000 psi. Most preferably, the flexural modulus of the intermediate layer is from about 2,000 psi to about 200,000 psi.

Similarly, it is preferable that the golf balls of the present invention have a cover layer with a flexural modulus from about 10,000 psi to about 150,000 psi. More preferably, the flexural modulus of the cover layer is from about 15,000 psi to about 120,000 psi. Most preferably, the flexural modulus of the cover layer is from about 18,000 psi to about 110,000 psi.

The golf ball compositions of the present invention have a core hardness from about 50 Shore A to about 90 Shore D. Preferably, the core has a Shore D hardness from about 30 to about 65. More preferably, the core has a Shore D hardness from about 35 to about 60. An intermediate layer of the golf balls of the present invention preferably has a hardness of from about 60 Shore A to about 85 Shore D. More preferably, the hardness of an intermediate layer is from about 65 Shore A to about 80 Shore D. The cover layer of the golf balls of the present invention preferably has a Shore D hardness from about 40 to about 90. More preferably, the Shore D hardness of the cover layer is from about 45 to about 85. Most preferably, the cover layer has a Shore D hardness from about 50 to about 80.

Forming a blend of a polyamide and a nonionomer dramatically improves the ability to control the mechanical properties of the blend, including tensile and flexural modulus and Shore hardness.

The compositions of the invention provide golf balls and covers having the durability and distance of ionomer covered two-piece balls and the feel, click and control of balata covered three-piece balls.

Unless otherwise noted, all % values given herein are by weight percent (i.e. wt. %).

EXAMPLES

The following non-limiting examples are merely illustrative of the preferred embodiments of the present invention, and are not to be construed as limiting the invention, the scope of which is defined by the appended claims.

Tests were performed to compare the durability of a golf ball cover based on blends of a polyamide polymer and nonionomer polymers with "standard" ball covers based on blends of ionomer resins. The polymer blends are given in Tables I through III. In Tables I and II, the amount of each component is given in parts by weight, based on 100 parts of the polyamide-nonionomer blend i.e., designated as phr or parts per hundred. Additionally, 5 parts of a first color concentrate is added to 100 parts of each blend of Examples 1 through 8. The first color concentrate consists of about 35 wt. % to about 45 wt. % of $TiO_2$ dispersed in a carrier polymer of polyamide 12 (RILSAN AMNO). In Table III, the amount of each component for the competitive examples and for the controls is given in parts by weight, based on 100 parts of the ionomer blend. Additionally, 5 parts of a second color concentrate is added to 100 parts of each blend of Examples C10 through C13, Control C1 and Control C2. The second color concentrate consists of about 35 wt. % to about 45 wt. % of $TiO_2$ dispersed in a carrier polymer of a commercial ethylene-based ionomer available from DuPont and believed to comprise 9–12% methacrylic acid and to be partially neutralized with sodium.

The initial velocity is determined using a Titleist-made Dual Pendulum Testing Machine configured to strike a golf ball with a face-plate angled at approximately 13°.

The coefficient of restitution (hereafter "COR") is evaluated by shooting a golf ball out of an air cannon at a steel plate. COR is calculated by dividing the rebound velocity of the golf ball by the incoming velocity. Thus, a ball with a high coefficient of restitution dissipates a smaller fraction of its total energy when colliding with the plate and rebounding therefrom than does a ball with a low coefficient of restitution. COR testing is conducted over a range of incoming velocities and determined at an inbound velocity of 125 ft/s.

Durability is determined by using a hitting machine to hit a golf ball into a catching net, then automatically returning the ball into position where it is hit again. The test continues until the pre-set number of hits is reached, 600 hits being the maximum number of hits used herein, or until the golf ball fails, as judged by visual observations. A minimum sample size of 12 golf balls is used, each subjected to the pre-set number of hits. The golf balls are hit at room temperature, about 22° C.

The shear resistance rating is determined by using a Miya mechanical Golf Swing Machine to make two hits on each of 6–12 substantially identical golf balls of the same composition with either a sand wedge or a pitching wedge. First, the test conditions are adjusted and verified so that a control golf ball with a balata cover produces a rating of 5 on the shear resistance rating scale where a numerical rating from 1 (best: no visible damage to cover or paint) to 5 (worst: excessive cover shear, heavy material removal or severe material removal) is assigned. Following the calibration procedure, each experimental golf ball is tested and assigned a rating based upon visible manifestations of damage after being struck.

Golf ball cover hardness (Shore D) is determined by ASTM method D-2240 by placing the probe on the flat surface of the golf ball. Flexural modulus is determined by ASTM method D-790.

Examples 1 through 4 incorporate a cover blend of polyamide 12, available from Elf Atochem S.A., and a functionalized SEBS block copolymer TPE available from Shell USA. Examples 5 through 8 incorporate a cover blend of polyamide 12 and a TPE block copoly(amide-ether) available from Elf Atochem N.A. Example 9 incorporates a cover blend of polyamide 12 and a block copoly(ester-ether) available from DuPont.

Comparative Examples C10 through C13 incorporate a cover blend of two commercially available ethylene-based ionomers, a very low modulus ionomer believed to comprise 9–12% methacrylic acid and to be partially neutralized with sodium and an ionomer believed to comprise 13–17% methacrylic acid and to be partially neutralized with lithium, both available from DuPont.

Control 1 incorporates a cover blend of two commercially available ethylene-based ionomers (55% of a very low modulus ionomer believed to comprise 9–12% methacrylic acid and to be partially neutralized with sodium and 45% of an ionomer believed to comprise 13–17% methacrylic acid and to be partially neutralized with lithium) of the type such as is used in certain commercial golf balls for the purposes of comparison with the examples. Control 2 incorporates a cover blend of two commercially available ethylene-based ionomers (50% of an ionomer believed to comprise 13–17% methacrylic acid and to be partially neutralized with lithium and 50% of an ionomer believed to comprise 17–20% methacrylic acid and to be partially neutralized with sodium) of the type such as is used in certain commercial golf balls for the purposes of comparison with the examples.

When compared to the ionomer blend golf balls, the golf balls of the invention provide improved feel, comparable initial velocity, and equivalent or improved durability and shear resistance. The examples demonstrate that golf ball covers formed from blends incorporating polyamide 12 and a block copoly(amide-ether) TPE, a functionalized SEBS block copolymer TPE, or a TPE block copoly(ester-ether) can sustain at least 600 hits without failure of half of the golf balls undergoing durability testing.

Furthermore, the golf balls of all the examples have good initial velocity which approaches the upper limit for velocity of a struck golf ball, as defined by the Rules of Golf. These rules, as established by the USGA, include the following rule for initial velocity:

> The velocity of the ball shall not be greater than 250 feet (76.2 m) per second when measured on apparatus approved by the USGA. A maximum tolerance of 2% will be allowed. The temperature of the ball when tested will be 23±1° C.

Thus, the maximum allowable initial velocity is 255 ft/s (250 ft/s plus the 2% tolerance of 5 ft/s) under the Rules of Golf. Therefore, golf ball manufacturers strive to come as close to the 255 ft/s maximum as possible without exceeding it to increase the distance over which a golfer can drive a golf ball. Thus, the improvement imparted by making golf balls from the compositions of the present invention which gets a golf ball closer to the 255 ft/s limit should be looked at favorably.

In addition, the golf balls of all the examples have shear resistance equal to or better than the comparative examples and controls. In particular, Examples 1 through 4 and 5 through 8 demonstrate that as the polyamide concentration increases in a golf ball cover blend comprising polyamide, the shear resistance of the cover improves.

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments as falling within the true spirit and scope of the present invention.

TABLE I

PROPERTIES OF POLYAMIDE AND FUNCTIONALIZED SEBS GOLF BALL COVER BLENDS

| Example Number | 1 | 2 | 3 | 4 |
|---|---|---|---|---|
| Polyamide 12[a] | 25 | 50 | 75 | 85 |
| Functionalized SEBS[b] | 75 | 50 | 25 | 15 |
| Ball Cover Hardness (Shore D) | 51 | 62 | 72 | 74 |
| Initial Velocity[c] (ft/sec) | 250.5 | 251.4 | 252.8 | 253.4 |
| Coefficient of Restitution @ 125 ft/sec Inbound Velocity | 0.796 | 0.801 | 0.814 | 0.826 |
| Durability Test, First Failure at # of Hits Up to 600 Hits[e] | None | None | None | 50 |
| Durability Test, 50% Failure Up to 600 Hits[e] | None | None | None | 300 |
| Shear Resistance Rating[d] | 4.5 | 4.0 | 1.0 | 1.0 |

[a]RILSAN AMNO polyamide 12, flexural modulus of about 174 kpsi
[b]KRATON FG 1901 X (maleic anhydride grafted SBBS)
[c]Initial velocity of 1.580 inch diameter core = 252.2 ft/s
[d]1 is best, 5 is worst
[e]At room temperature

TABLE II

PROPERTIES OF POLYAMIDE AND BLOCK COPOLY(AMIDE) TPE OR COPOLY(ESTER) TPE GOLF BALL COVER BLENDS

| Example Number | 5 | 6 | 7 | 8 | 9 |
|---|---|---|---|---|---|
| Polyamide 12[a] | 25 | 50 | 75 | 85 | 25 |
| Block Copoly(amide-ether)[b] | 75 | 50 | 25 | 15 | — |
| Block Copoly(ester-ether)[c] | — | — | — | — | 75 |
| Ball Cover Hardness (Shore D) | 47 | 62 | 69 | 72 | 45 |
| Initial Velocity[d] (ft/sec) | 252.1 | 251.7 | 252.7 | 253.5 | 250.7 |
| Coefficient of Restitution @ 125 ft/sec Inbound Velocity | 0.800 | 0.807 | 0.819 | 0.826 | 0.794 |
| Durability Test, First Failure at # of Hits Up to 600 Hit[f] | None | None | 400 | None | None |
| Durability Test, 50% Failure Up to 600 Hits[f] | None | None | 500 | None | None |
| Shear Resistance Rating[c] | 2.5 | 2.3 | 1.8 | 1.0 | 4.0 |

[a]RILSAN AMNO Polyamide 12, flexural modulus of about 174 kpsi
[b]PEBAX3533
[c]HYTREL3078
[d]Initial velocity of 1.580 inch diameter core = 252.2 ft/s for Examples 5–8, = 251.8 ft/s for Example 9
[e]1 is best, 5 is worst
[f]At room temperature

TABLE III

PROPERTIES OF COMPARATIVE EXAMPLE GOLF BALL COVER BLENDS AND CONTROLS

| Example Number | C10 | C11 | C12 | C13 | Control 1 | Control 2[a] |
|---|---|---|---|---|---|---|
| SURLYN 7940[b] | 25 | 50 | 75 | 85 | 45 | 50 |
| SURLYN 8320[c] | 75 | 50 | 25 | 15 | 55 | — |
| Ball Cover Hardness (Shore D) | 53 | 57 | 65 | 69 | 57 | 72 |
| Initial Velocity[d] (ft/sec) | 250.8 | 251.3 | 252.6 | 252.9 | 251.3 | 253.8 |
| Coefficient of Restitution @ 125 ft/sec Inbound Velocity | 0.799 | 0.803 | 0.815 | 0.815 | 0.802 | 0.823 |
| Durability Test, First Failure at # of Hits Up to 600 Hits[f] | None | None | None | None | None | 250 |

TABLE III-continued

PROPERTIES OF COMPARATIVE EXAMPLE GOLF BALL COVER BLENDS AND CONTROLS

| Example Number | C10 | C11 | C12 | C13 | Control 1 | Control 2[a] |
|---|---|---|---|---|---|---|
| Durability Test, 50% Failure Up to 600 Hits[f] | None | None | None | None | None | 284 |
| Shear Resistance Rating[e] | 4.5 | 3.5 | 3.0 | 2.5 | 4.0 | 1.5 |

[a]50% SURLYN 7940/50% SURLYN AD8140 (17–20% acid ionomer partially neutralized with sodium)
[b]13–17% acid ionomer partially neutralized with lithium
[c]9–12% acid very low modulus ionomer partially neutralized with sodium
[d]Initial velocity of 1.580 inch diameter core = 252.2 ft/s
[e]1 is best, 5 is worst
[f]At room temperature

What is claimed is:

1. A golf ball comprising at least one core layer, a cover layer, and at least one intermediate layer disposed between at least one said core layer and the cover layer, wherein at least one said core layer or at least one said intermediate layer comprises a polymer composition comprising about 1 to about 99 weight percent of at least one nonionomer thermoplastic polymer selected from the group consisting of poly(ethylene terephthalate), poly(butylene terephthalate), poly(trimethylene terephthalate), polycarbonate, poly (imide), poly(vinyl alcohol), poly(vinyl acetate), poly (silane), poly(vinylidene fluoride), acrylonitrile-butadiene-styrene copolymer, olefinic homopolymers, block copoly (ester-ester), block copoly(ester-ether), block copoly(amide-ester), block copoly(amide-ether), block copoly(urethane-ester), block copoly(urethane-ether), a thermoplastic and elastomer blend comprising polypropylene and ethylene-propylene-diene terpolymer, or ethylene-propylene copolymer rubber, wherein the rubber is dynamically vulcanized, metallocene-catalyzed polymers, a thermoplastic and elastomer blend comprising polypropylene and ethylene-propylene-diene monomer, polyethylene, polypropylene, a copolymer of ethylene or propylene with acrylic acid or methacrylic acid, a polymer formed with the use of metallocene catalysts and consisting essentially of a copolymer of ethylene and butene, a copolymer of ethylene and hexene or a copolymer of ethylene and octene, a terpolymer formed with the use of metallocene catalysts and consisting essentially of a polymer of ethylene, propylene and a diene monomer, poly(methyl acrylate), poly(methyl methacrylate), acrylonitrile-styrene-butadiene terpolymer, a terpolymer consisting essentially of an α-olefin monomer containing from 2 to 10 carbon atoms, an alkyl acrylate or an alkyl alkylacrylate monomer, and a glycidyl acrylate or a glycidyl alkylacrylate monomer, wherein each alkyl group ranges, independently, from methyl to decyl inclusive and may be linear or branched, a copolymer consisting essentially of an α-olefin monomer containing from 2 to 10 carbon atoms and a vinyloxazoline or 1-alkyl vinyloxazoline monomer, wherein the alkyl group ranges from methyl to decyl inclusive and may be linear or branched, a terpolymer consisting essentially of an α-olefin monomer containing from 2 to 10 carbon atoms, an alkyl acrylate or an alkyl alkylacrylate monomer, and a vinyloxazoline or 1-alkyl vinyloxazoline monomer, wherein each alkyl group ranges, independently, from methyl to decyl inclusive and may be linear or branched, a copolymer consisting essentially of an α-olefin monomer containing from 2 to 10 carbon atoms and carbon monoxide, a terpolymer consisting essentially of a first α-olefin monomer containing from 2 to 10 carbon atoms, a second α-olefin monomer containing from 2 to 10 carbon atoms, and carbon monoxide, a copolymer consisting essentially of an α-olefin monomer containing from 2 to 10 carbon atoms and sulfur dioxide, a terpolymer consisting essentially of a first α-olefin monomer containing from 2 to 10 carbon atoms, a second α-olefin monomer containing from 2 to 10 carbon atoms, and sulfur dioxide, a copolymer consisting essentially of an α-olefin monomer containing from 2 to 10 carbon atoms and maleic anhydride, a terpolymer consisting essentially of an α-olefin monomer containing from 2 to 10 carbon atoms, maleic anhydride, and carbon monoxide; a terpolymer consisting essentially of an α-olefin monomer containing from 2 to 10 carbon atoms, maleic anhydride, and sulfur dioxide, and mixtures thereof, and about 99 to about 1 weight percent of at least one polyamide polymer selected from the group consisting of polyamide 6, polyamide 11, polyamide 12, polyamide 4,6, polyamide 6,6, polyamide 6,9, polyamide 6,10, polyamide 6,12, polyamide 6/6,6, polyamide 6,6/6,10, polyamide 6/6,T, polyamide 6/6, 6/6,10, and mixtures thereof.

2. The golf ball of claim 1, wherein the golf ball has a coefficient of restitution of at least 0.79.

3. The golf ball of claim 1, wherein the polyamide polymer is selected from the group consisting of polyamide homopolymers, polyamide copolymers and mixtures thereof.

4. The golf ball of claim 1, wherein the polyamide polymer has a flexural modulus of at least about 30,000 psi.

5. The golf ball of claim 4, wherein the polyamide polymer has a flexural modulus of about 30,000 psi to about 500,000 psi.

6. The golf ball of claim 1, wherein the polymer composition further comprises at least one additional material.

7. The golf ball of claim 6, wherein the at least one additional material comprises dyes, whitening agents, UV absorbers, processing aids, metal particles, metal powders, antioxidants, stabilizers, softening agents, plasticizers, impact modifiers, toughening agents, foaming agents, fillers, reinforcing materials, compatibilizers, and mixtures thereof.

8. The golf ball of claim 1, wherein at least one said intermediate layer comprises a tensioned elastomeric material formed of the polymer composition that is wound about an outermost one of the at least one said core layer.

9. The golf ball of claim 1, wherein the at least one said core layer, the cover layer, or the at least one said intermediate layer further comprises a thermoset polymer.

10. The golf ball of claim 9, wherein the thermoset polymer comprises poly(isoprene), poly(butadiene), poly (urethane), poly(urea), or mixtures thereof.

11. The golf ball of claim 1, wherein the at least one said core layer or the at least one said intermediate layer is comprised of said polymer composition and wherein the cover layer is formed of at least one material selected from the group consisting of ionic or nonionic olefinic polymers, styrene-(hydrogenated butadiene)-styrene ionomers, thermoset poly(isoprene), thermoset poly(butadiene), thermoset poly(urethanes), thermoset poly(ureas), and mixtures thereof.

12. The golf ball of claim 11, wherein the at least one said core layer or the at least one said intermediate layer comprises about 15 to about 75 weight percent of at least one nonionomer thermoplastic polymer and about 85 to about 25 weight percent of at least one polyamide polymer.

13. The golf ball of claim 1, wherein the polymer composition further comprises at least one density-adjusting filler.

14. A golf ball comprising at least one core layer, a cover layer, and at least one intermediate layer disposed between at least one said core layer and the cover layer, wherein the cover layer comprises a polymer composition comprising about 25 to about 55 weight percent of at least one nonionomer thermoplastic polymer selected from the group consisting of poly(ethylene terephthalate), poly(butylene terephthalate), poly(trimethylene terephthalate), polycarbonate, poly(imide), poly(vinyl alcohol), poly(vinyl acetate), poly(silane), poly(vinylidene fluoride), acrylonitrile-butadiene-styrene copolymer, olefinic homopolymers, block copoly(ester-ester), block copoly (ester-ether), block copoly(amide-ester), block copoly (amide-ether), block copoly(urethane-ester), block copoly (urethane-ether), a thermoplastic and elastomer blend comprising polypropylene and ethylene-propylene-diene terpolymer, or ethylene-propylene copolymer rubber, wherein the rubber is dynamically vulcanized, metallocene-catalyzed polymers, and mixtures thereof and about 75 to about 45 weight percent of at least one polyamide polymer selected from the group consisting of polyamide 6, polyamide 11, polyamide 12, polyamide 4,6, polyamide 6,6, polyamide 6,9, polyamide 6,10, polyamide 6,12, polyamide 6/6,6, polyamide 6,6/6,10, polyamide 6/6,T, polyamide 6/6, 6/6,10, and mixtures thereof.

15. The golf ball of claim 14, wherein wherein the polyamide polymer is selected from the group consisting of polyamide homopolymers, polyamide copolymers and mixtures thereof.

16. The golf ball of claim 14, wherein the polyamide homopolymer is selected from the group consisting of polyamide 6, polyamide 11, polyamide 12, polyamide 4,6, polyamide 6,6, polyamide 6,9, polyamide 6,10, polyamide 6,12, and mixtures thereof.

17. The golf ball of claim 14, wherein the polyamide copolymer is selected from the group consisting of polyamide 6/6,6, polyamide 6,6/6,10, polyamide 6/6,T, polyamide 6/6,6/6,10, and mixtures thereof.

18. The golf ball of claim 14, wherein the nonionomer thermoplastic polymer is selected from the group consisting of poly(ethylene terephthalate), poly(butylene terephthalate), poly(trimethylene terephthalate), polycarbonate, poly(imide), poly(vinyl alcohol), poly(vinyl acetate), poly(silane), poly(vinylidene fluoride), acrylonitrile-butadiene-styrene copolymer, olefinic homopolymers, olefinic copolymers, block copoly(ester-ester), block copoly(ester-ether), block copoly(amide-ester), block copoly(amide-ether), block copoly(urethane-ester), block copoly(urethane-ether), a thermoplastic and elastomer blend comprising polypropylene and ethylene-propylene-diene terpolymer, or ethylene-propylene copolymer rubber, wherein the rubber is dynamically vulcanized, and mixtures thereof.

19. A method of making the golf ball of claim 14, comprising:

forming a core having at least one core layer;

forming at least one intermediate layer disposed about the core; and forming a cover disposed about the at least one said intermediate layer.

20. The method of claim 19, wherein the at least one core layer has a center that is solid, fluid, or hollow.

21. The method of claim 19, wherein the center is solid and comprises vulcanized polybutadiene.

22. A golf ball comprising at least one core layer, a cover layer, and at least one intermediate layer disposed between at least one said core layer and the cover layer, wherein the at least one said intermediate layer comprises a polymer blend comprising about 1 to about 99 weight percent of at least one nonionomer thermoplastic polymer and about 99 to about 1 weight percent of at least one polyamide polymer selected from the group consisting of polyamide 6, polyamide 11, polyamide 12, polyamide 4,6, polyamide 6,6, polyamide 6,9, polyamide 6,10, polyamide 6,12, polyamide 6/6,6, polyamide 6,6/6,10, polyamide 6/6,T, polyamide 6/6, 6/6,10, and mixtures thereof, wherein said intermediate layer has a Shore D hardness of not greater than about 74, and wherein the nonionomer thermoplastic polymer is selected from the group consisting of poly(ethylene terephthalate), poly(butylene terephthalate), poly (trimethylene terephthalate), polycarbonate, poly(imide), poly(vinyl alcohol), poly(vinyl acetate), poly(silane), poly (vinylidene fluoride), acrylonitrile-butadiene-styrene copolymer, olefinic homopolymers, block copoly(ester-ester), block copoly(ester-ether), block copoly(amide-ester), block copoly(amide-ether), block copoly(urethane-ester), block copoly(urethane-ether), a thermoplastic and elastomer blend comprising polypropylene and ethylene-propylene-diene terpolymer, or ethylene-propylene copolymer rubber, wherein the rubber is dynamically vulcanized, metallocene-catalyzed polymers, and mixtures thereof.

23. The golf ball of claim 22, wherein the polyamide polymer is selected from the group consisting of polyamide homopolymers, polyamide copolymers and mixtures thereof.

24. The golf ball of claim 22, wherein the polyamide homopolymer is selected from the group consisting of polyamide 6, polyamide 11, polyamide 12, polyamide 4,6, polyamide 6,6, polyamide 6,9, polyamide 6,10, polyamide 6,12, and mixtures thereof.

25. The golf ball of claim 22, wherein the polyamide copolymer is selected from the group consisting of polyamide 6/6,6, polyamide 6,6/6,10, polyamide 6/6,T, polyamide 6/6,6/6,10, and mixtures thereof.

26. A method of making the golf ball of claim 22, comprising:

forming a core having at least one core layer;

forming at least one intermediate layer disposed about the core; and forming a cover disposed about the at least one said intermediate layer.

27. The method of claim 26, wherein the at least one core layer has a center that is solid, fluid, or hollow.

28. The method of claim 27, wherein the center is solid and comprises vulcanized polybutadiene.

* * * * *